US005954265A

United States Patent [19]

Hall et al.

[11] Patent Number: 5,954,265

[45] Date of Patent: Sep. 21, 1999

[54] DIAGNOSTIC SYSTEM FOR A FUEL-FIRED WATER HEATER

[75] Inventors: Jacob H. Hall, Dadeville; David L. Henderson, Millbrook; Jeffrey A. Leep, Wetumpka, all of Ala.

[73] Assignee: Rheem Manufacturing Company, New York, N.Y.

[21] Appl. No.: 09/109,604

[22] Filed: Jul. 2, 1998

[51] Int. Cl.[6] ..... G05D 23/00

[52] U.S. Cl. ..... 236/94; 431/14

[58] Field of Search ..... 236/94, 20 R, 236/21 R, 21 B; 431/13, 14, 15, 16; 340/517, 523

[56] References Cited

U.S. PATENT DOCUMENTS

| | | | |
|---|---|---|---|
| 3,939,456 | 2/1976 | Curtis et al. | 236/94 X |
| 4,827,730 | 5/1989 | Doi et al. | 236/94 X |
| 5,515,297 | 5/1996 | Bunting | 431/14 X |

*Primary Examiner*—Harry B. Tanner
*Attorney, Agent, or Firm*—Konneker & Smith, P.C.

[57] ABSTRACT

A fuel-fired water heater has a series of control and operating components which, with electrical power being supplied to the water heater circuitry via a power switch, are electrically actuatable in a predetermined sequence to supply combustion heat to water contained in a tank portion of the water heater to return the temperature of the water to a heated setpoint temperature in response to the water temperature falling below such setpoint temperature. LED diagnostic indicating lights are wired into the water heater circuitry in a manner such that each indicating light is associated with a different one of the electrically coupled components. As the components are sequentially actuated during a water heating cycle, the LED lights are successively illuminated. If one of the components malfunctions during such heating cycle, one or more of the indicating lights remains unilluminated, with the last illuminated light being indicative of the last component in the sequence which functioned properly, thereby facilitating the ready identification of the component which malfunctioned. The LED indicating lights are supported in a single row on a housing-mounted circuit board to which electrical indicating light leads from the water heater control circuit are connected. One of the LED lights is a power indicating light and, like the other indicating lights, has a resistor in an electrical trace leading to the light. The power indicating light and its associated resistor are physically isolated from the other indicating lights and their associated resistors by an interior housing barrier wall.

26 Claims, 3 Drawing Sheets

DIAGNOSTIC SYSTEM FOR A FUEL-FIRED WATER HEATER

BACKGROUND OF THE INVENTION

The present invention generally relates to fuel-fired heating appliances and, in a preferred embodiment thereof, more particularly relates to a fuel-fired water heater having a specially designed malfunctioning component diagnostic system incorporated therein.

As conventionally manufactured, a fuel-fired water heater typically comprises an insulated tank for containing water to be heated, and a fuel-fired combustion system for transferring heat to the water to maintain it at a predetermined heated temperature for on-demand delivery from the tank to various items, such as faucets, shower heads, dishwashers and the like operatively connected to the water heater. Various electrically actuatable components are incorporated into the overall water heater apparatus to automatically add heat to the tank water when its temperature falls below the heated set point temperature.

For example, a thermostat is used to sense a drop in tank water temperature and responsively activate an ignition controller which sequentially opens pilot and main portions of a fuel valve which are connected to a burner structure, and ignites the fuel discharged from the burner. Hot combustion products from the burning fuel are flowed through a flue structure extending through the tank water to thereby add combustion heat to the water and return it to its setpoint temperature at which point the thermostat deactivates the ignition controller to terminate the flow of fuel to the burner apparatus.

Like all mechanical and electrical components, the operational and control components in a fuel-fired water heater are subject to failure and malfunction which ends the water heater's ability to maintain the tank water at the desired heating setpoint temperature. When such component failure or malfunction occurs, all that the typical water heater owner is usually aware of is that hot water is no longer available from the unit. Accordingly, a water heater service technician (such as a plumber) is typically called in to fix the water heater.

While a water heater service technician may carry various diagnostic tools, such as voltage probes and the like, which may be used to individually check the various water heater components for proper operation, a very common repair mode is to simply leave the diagnostic tools in the truck and begin to replace the individual water heater components until the water heater is able to heat its tank water again. This common repair technique, of course, tends to be both inefficient and expensive if the first replaced component is not the failed one. Oftentimes, several perfectly good components are needlessly replaced before the water heater is operative again.

From the foregoing it can readily be seen that a need exists for an improved technique for diagnosing a problem in a water heater system in a manner such that a failed or malfunctioning component can be readily identified and efficiently replaced, adjusted or repaired. It is to this need that the present invention is directed.

SUMMARY OF THE INVENTION

In carrying out principles of the present invention, in accordance with a preferred embodiment thereof, a liquid heating apparatus, which is representatively in the form of a fuel-fired water heater, is provided with a specially designed built-in, nonintrusive diagnostic system for efficiently identifying a malfunctioning component of the water heater.

The water heater comprises a vessel for containing a liquid to be heated, a heating system, and the diagnostic system. The heating system is operative during a heating cycle to utilize electrical power and combustible fuel from sources thereof to maintain the liquid at a predetermined heated temperature by creating fuel combustion heat and transferring it to the liquid in response to the temperature of the liquid falling below the predetermined heated temperature. The heating system includes a series of electrical components successively operative in a predetermined sequence during the heating cycle. These components are connected in an electrical circuit and representatively comprise an electrical power switch, a thermostat coupled to the electrical power switch, an ignition control coupled to the thermostat, a fuel valve coupled to the ignition control, and an energy cutoff switch.

From a broad perspective, the diagnostic system is operative to facilitate the identification of a malfunctioning one of the series of electrical components by creating a diagnostic signal indicative of the last component in the sequence thereof to properly function during a heating cycle.

In a preferred embodiment thereof, the diagnostic system includes a series of LED indicating lights each associated with one of the components, the series of indicating lights being supported in an ordered array corresponding in a predetermined manner to the sequence in which the series of components are electrically actuatable. The diagnostic system is operative to successively illuminate each indicating light, in response to the presence of a predetermined voltage condition of its associated component, in a manner causing the last illuminated light to be indicative of the last component in the sequence thereof to have functioned properly.

Representatively, the series of electrically actuatable components are each successively operative in the predetermined sequence to receive an electrical voltage from a preceding component and responsively cause the creation of an electrical actuation signal useable by a subsequent component in the sequence thereof. The diagnostic system functions to sense the successive electrical actuation signals created by the components during operation of the heating system, and use the sensed electrical actuation signals to create the visual diagnostic signal indicative of the last component in the sequence thereof to properly function.

In accordance with another aspect of the invention, a circuit board supports the LED indicating lights and is representatively disposed within a light housing structure. A series of electrical leads are interconnected between the circuit board and the electrical circuit in which the sequentially actuatable electrical components are connected. Each lead is associated with one of the components and is operative to supply electrical power, via the circuit board, to the LED indicating light associated with the component.

Each lead has a connection point on the circuit board, and a resistor connected in an electrical trace that interconnects the lead to its associated LED indicating light. One of the leads is a power indicating lead operative to transmit electrical power to the circuit board in response to electrical power being supplied from a source thereof to the series of components. A barrier wall is positioned adjacent the circuit board and serves to physically isolate the power LED indicating light and its associated resistor from the other LED indicating lights and their associated resistors in the event the power LED indicating light or its associated resistor becomes dislodged from the circuit board.

DETAILED DESCRIPTION

Figure 1:
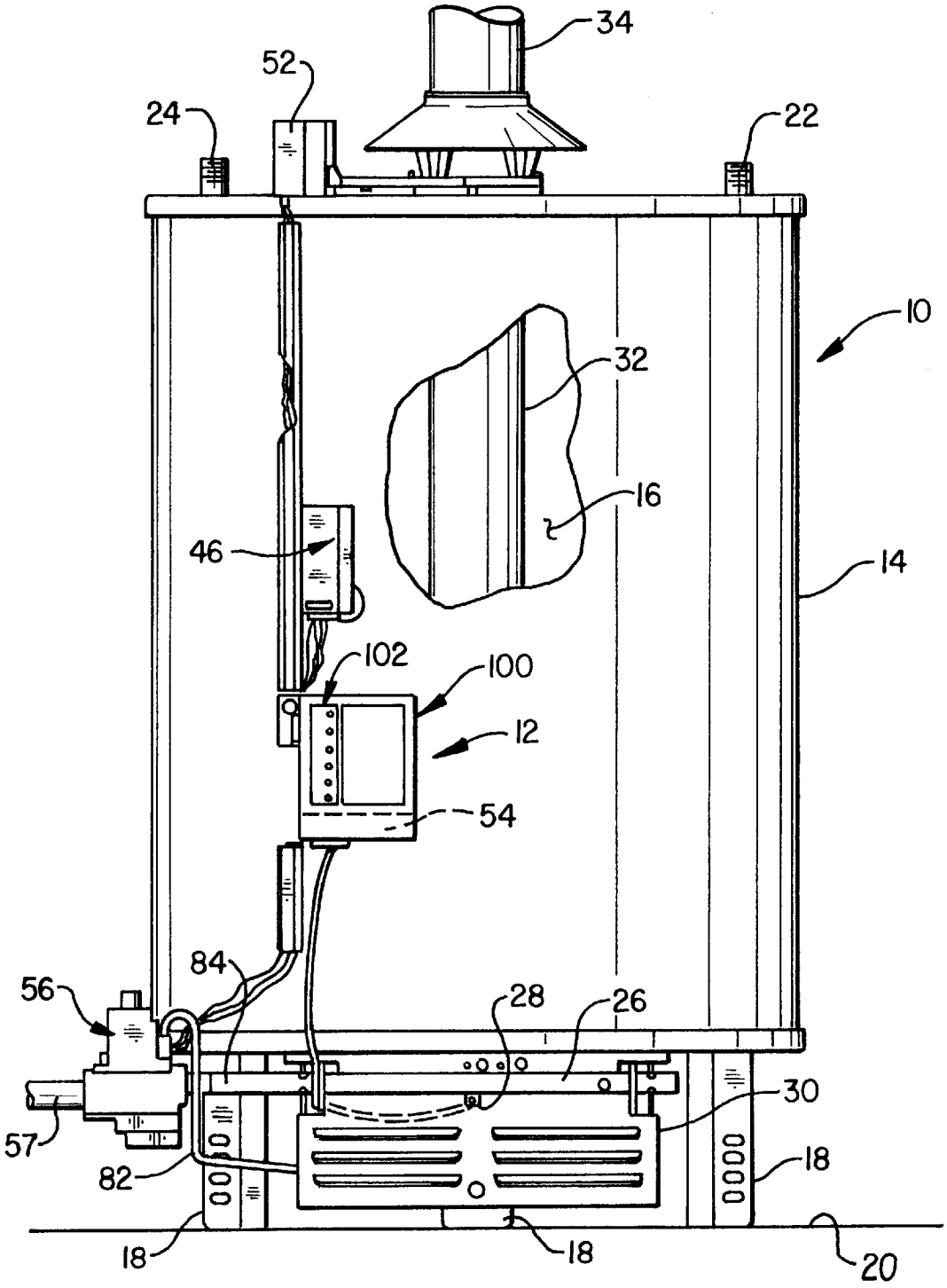
FIG. 1 is a simplified, partially cut away side elevational view of a representative fuel-fired water heater in which a specially designed diagnostic system embodying principles of the present invention is incorporated.

Illustrated in simplified, partially cut away form in FIG. 1 is a gas-fired water heater 10 which embodies principles of the present invention via its incorporation therein of a specially designed diagnostic system 12 as subsequently described herein. Except for the diagnostic system 12, the water heater 10 is of a conventional design and is representative of a variety of other types of fuel-fired liquid heating apparatus, such as boilers and other types of water heaters, into which the diagnostic system 12 could be advantageously incorporated.

Water heater 10 includes an insulated, vertically oriented cylindrical tank 14 adapted to hold a quantity of pressurized water 16 to be heated to a predetermined heated setpoint temperature. Leg structures 18 extending downwardly from the bottom end of the tank 14 support the tank on a horizontal support surface, such as a floor 20, in an elevated relationship therewith. At the upper end of the tank 14 are an inlet fitting 22 for receiving pressurized water to be heated within the tank 14, and an outlet fitting 24 for discharging heated water from the tank to various plumbing fixtures such as sinks, showers, dishwashers and the like when required.

Main and pilot gas burners 26,28 are supported adjacent the bottom end of the tank 14 and are communicated with a combustion chamber structure 30 which, in turn, communicates with a vertical flue 32 passing upwardly through a central interior portion of the tank 14 and the water 16 stored therein. The upper end of the flue 32 is connectable to a vent stack 34 disposed at the upper end of the tank 14, and has a conventional pivotable flue damper (not shown) therein.

Figure 2:
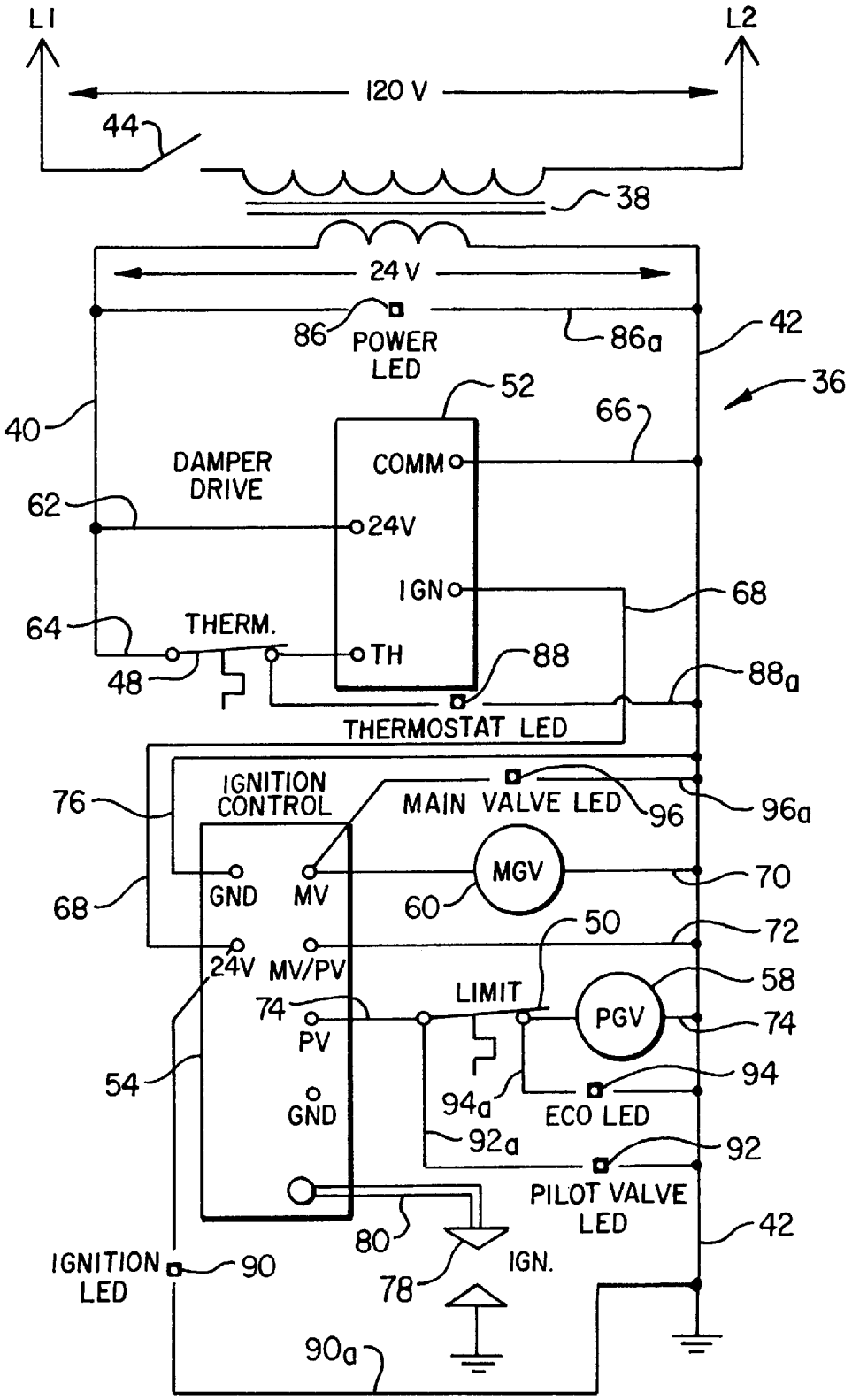
FIG. 2 is a simplified schematic wiring diagram of the water heater control system into which the diagnostic system is nonintrusively incorporated.

Various conventional electrical control and operating components form a part of the overall water heater 10 and are operative to maintain the tank water 16 at the predetermined heating setpoint temperature and add fuel combustion heat to the water during a heating or "recovery" cycle when the water temperature falls to a level below the setpoint temperature. Referring now to FIGS. 1 and 2, these components are connected in an electrical circuit 36 including a pair of 120 volt AC power leads L1 and L2 connected to one side of a transformer 38, and a pair of 24 volt AC leads 40,42 (lead 42 being neutral relative to ground) connected to the other side of the transformer 38. The electrical components connected in the circuit 36 include (1) a power switch 44, (2) a thermostat 46 having a main switch portion 48, and a high limit or energy cutoff (ECO) switch portion 50, (3) a damper drive control 52, (4) an ignition control 54, and (5) a gas valve 56 supplied with gaseous fuel via a supply pipe 57 and having a pilot portion 58 and a main portion 60.

Power switch 44 is connected in the high voltage lead L1, and the damper control 52, as schematically indicated in FIG. 2, is connected to low voltage lead 40 by leads 62 and 64, and to low voltage lead 42 by lead 66. The normally open main thermostat switch 48 is connected in lead 64, and the damper control 52 is connected as shown to the ignition control 54 by a lead 68. Ignition control 54 is coupled to the low voltage lead 42 by leads 70, 72, 74 and 76. Additionally, the ignition control 54 is coupled to a conventional pilot electrode assembly 78, operatively associated with the pilot gas valve portion 58, by an ignitor, sensor and ignition cable 80. The main gas valve portion 60 is connected in the lead 70, and the normally closed high limit or ECO switch 50 is connected in series with the pilot gas portion 58 in the lead 74.

During operation of the water heater 10, closure of the power switch 44 provides 24 volt AC power to the leads 40 and 42. While the water 16 in the tank 14 remains at or above its setpoint heating temperature, the thermostat switch 48 remains open, and the rest of the previously described components in the circuit 36 remain de-energized. However, when the thermostat 46 senses a fall in the water temperature below its heating setpoint temperature, the thermostat 46 initiates a conventional heating or "recovery" cycle by responsively closing its switch 48.

Closure of the thermostat switch 48 transmits electrical power to the damper control 52 via lead 64 to thereby cause the damper control 52 to open the flue damper. Opening of the flue damper in this manner closes a microswitch (not shown) associated therewith and causes the damper control 52 to transmit electrical power via lead 68 to the ignition control 54. Receipt of electrical power by the ignition control 54 via lead 68 causes the ignition control to initiate a programmed-in continuous retry ignition cycle in which the control attempts for 90 seconds to ignite the pilot burner 28 and then, if unsuccessful, turns off for five minutes before the next retry portion of the ignition cycle.

Upon initiation of the ignition cycle, the ignition control 54 outputs 24 volt AC electrical power through lead 74. If the ECO or high limit switch 50 is in its normally closed position, this opens the pilot gas valve 58 which, in turn, supplies gaseous fuel to the pilot burner 28 (see FIG. 1) via a pilot gas line 82. Gas discharged from the pilot gas valve 58 is ignited in a conventional manner by the pilot electrode assembly 78 to create a pilot flame. The creation of the pilot flame is proven by sensor circuitry within the cable 80 which, in turn, causes the ignition control 54 to transmit 24 volt AC electrical power to the main gas valve portion 60, via lead 70, to open the main gas valve portion.

Opening of the main gas valve portion 60 in this manner, flows gas to the main gas burner 26 (see FIG. 1) through a gas valve outlet pipe 84. Gas discharged from the main burner 26 is ignited by the previously created pilot flame and creates a main burner flame and resulting hot combustion gases which flow upwardly through the flue 32, past the open flue damper and outwardly through the vent stack 34. Heat from these combustion gases is transferred to the tank water 16 to return it to its setpoint heating temperature at which point the thermostat switch 48 opens to de-energize the damper control 52 and the ignition control 54, thereby closing the pilot and main gas valve portions 58,60 and terminating gas flow to the main and pilot burners 26 and 28.

As just described, during a heating or "recovery" cycle of the water heater 10, the circuit 36 functions in a conventional manner to sequentially actuate the various electrical components incorporated therein when heating is called for. Should one of these previously described components malfunction, the specially designed diagnostic system 12 of the present invention provides a visual indication of which component has malfunctioned, thereby permitting a service technician to readily isolate and remedy the problem in a manner making the previous practice of simply replacing components until the water heater properly functions again unnecessary.

Figure 3:
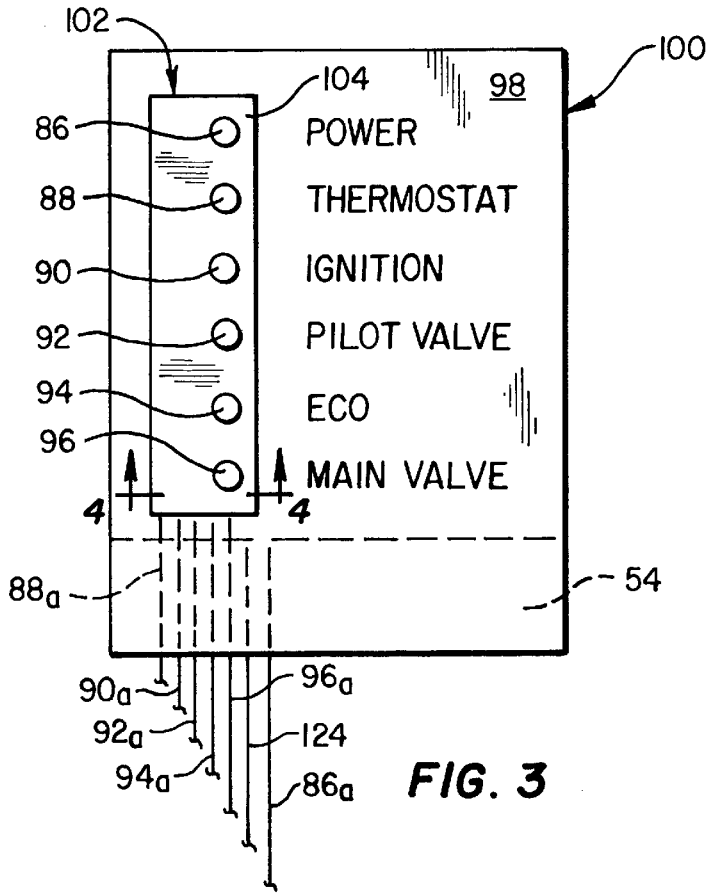
FIG. 3 is an enlarged front side elevational view of an LED indicating light panel portion of the diagnostic system.

Referring now to FIGS. 1–3, the diagnostic system 12 includes a vertical row of LED indicating lights 86, 88, 90, 92, 94 and 96 supported on the front wall 98 of a control panel 100 carried on the front side of the tank 14, the previously mentioned ignition control 54 being conveniently mounted in a bottom portion of the panel 100. Representatively, the uppermost LED indicating light 86 is green, with the rest of the indicating lights being red. For purposes later described herein, as shown in FIG. 3, identifying labels are suitably placed on the front panel side wall 98 rightwardly adjacent their associated LED indicating lights. Representatively, these labels comprise the terms "POWER", "THERMOSTAT", "IGNITION", "PILOT VALVE", "ECO", and "MAIN VALVE" respectively positioned rightwardly adjacent the LED indicating lights 86, 88, 90, 92, 94 and 96.

As schematically depicted in FIG. 2, the power LED 86 is connected in a lead 86*a* interconnected between the leads 40 and 42 between the transformer 38 and the damper control 52; the thermostat LED 88 is connected in a lead 88*a* interconnected between the thermostat switch 48 and the lead 42; the ignition LED 90 is connected in a lead 90*a* interconnected as shown between the ignition control terminal "24V" and the lead 42; the pilot valve LED 92 is connected in a lead 92*a* interconnected between the lead 42 and the lead 74 between the ignition control 54 and the ECO limit switch 50; the ECO LED 94 is connected in a lead 94*a* interconnected between the ECO limit switch 50 and the lead 42 between leads 74 and 92*a*; and the main valve LED 96 is connected in a lead 96*a* interconnected between the ignition control terminal MV and the lead 42 between the leads 76 and 70.

When the switch 44 is closed, 24 V AC voltage is applied to the leads 40 and 42, thereby illuminating the power LED 86. During periods when the temperature of the tank water 16 is at or above its setpoint heating temperature, the thermostat switch 48 is open, the flue damper is closed, and the rest of the LED lights 88, 90, 92, 94 and 96 are unilluminated. A water heating or "recovery" cycle is initiated when the thermostat 46 senses a drop in the temperature of the tank water 16 to a level below the setpoint temperature and responsively closes the thermostat switch 48, thereby illuminating the thermostat LED 88 in addition to the previously illuminated power LED 86. The closure of the thermostat switch 48 also causes the damper drive to open the flue damper and then transmit an electrical actuation signal to the ignition control 54 via the lead 68, thereby additionally illuminating the ignition LED 90.

Upon receipt of the electrical actuation signal via lead 68, the ignition control automatically initiates its previously described ignition sequence in which 24 volt AC electrical power is first transmitted to the lead 74, thereby illuminating the pilot valve LED 92 and (assuming that the ECO limit switch 50 is in its normally closed position) also illuminates the ECO LED 94, opens the pilot gas valve portion 58 and ignites the discharged pilot valve gas to create a pilot flame. Finally, when the pilot flame is proven via the sensor circuitry in the cable 80, the ignition control 54 outputs an electrical actuation signal to the main gas valve portion 60, via lead 70, and simultaneously illuminates the main valve LED 96. Opening of the main gas valve portion 60 causes gas to be discharged therefrom into the main burner 26 and ignited by the previously created pilot flame to add heat to the tank water 16 via the flue 32. When the heating demand is satisfied, and tank water 16 returned to its setpoint temperature, the thermostat switch 48 opens, the heating cycle is terminated, and all of the LED indicating lights except the power LED 86 go out.

As can be seen from the foregoing, during the heating cycle the components in the circuit 36 are successively actuated in a predetermined sequence by the creation of an electric actuating signal by a previous component in the sequence. The diagnostic system 12, during a given heating cycle, functions to sense a predetermined electrical actuation signal voltage condition for each component and responsively illuminate the LED indicating lights 86–96 in a sequence correlated in a predetermined manner with the actuation sequence of the components.

Specifically, closure of the switch 44 creates in conjunction with the switch 44 an actuation signal condition in which electrical power is transmitted to leads 40 and 42. Subsequent closure of the thermostat switch 48 creates in conjunction with the thermostat an actuation signal condition in which electrical power is transmitted through the thermostat switch 48 to the damper control 52, and then creates in conjunction with the ignition control 54 an actuation signal condition in which electrical power is received by the ignition control 54. The ignition control 54 then sequentially (1) creates in conjunction with the pilot gas valve portion 58 an actuation signal condition in which electrical actuation power is made available from the ignition control 54 to the pilot gas valve portion 58, (2) creates in conjunction with the ECO limit switch 50 an actuation signal condition in which electrical power is passed through the switch 50 to the pilot gas valve portion 58, and (3) creates in conjunction with the main gas valve portion 60 an actuation signal condition in which electrical actuation power is transmitted to the main gas valve portion 60 from the ignition control 54.

If, during a given heating cycle, all of the components schematically depicted in the circuit 36 function properly, all of the LED indicating lights will be illuminated until the end of the heating cycle, and the tank water 16 will be returned to its set point temperature, at which point all of the indicating lights except the power LED 86 will be turned off. However, if one of the components malfunctions during a heating cycle, the last LED indicating light to be illuminated during the uncompleted heating cycle will provide a visual indication of the last component to have functioned properly, thereby also providing a service technician with a clear indication as to which component malfunctioned.

For example, if the ignition control 54 malfunctions and fails to output an electrical actuation signal to the pilot gas valve portion 58 through lead 74, only the LED indicating lights 86, 88 and 90 will be illuminated—the subsequent lights 92, 94 and 96 will not come on. This visual signal indicates to the service technician that the ignition control 54 is receiving electrical power but is not outputting an electrical actuation signal to the pilot gas valve portion 58. The technician may thus focus on the ignition control 54, and repair or replace it, without wasting time in a trial and error replacement of other components in the circuit 36.

Thus, by providing visual indications of predetermined electrical actuation signal voltage conditions of the sequentially actuatable components in the water heater circuit 36, the LED indicating lights 86–96 pinpoint a malfunctioning component (or its associated wiring which, for purposes of this description, is considered to be a portion of such component) by correlating the circuit malfunction location to the last one of the indicating lights which is illuminated during a heating or "recovery" cycle of the water heater. The diagnostic system 12 in which the LED indicating lights 86–96 are incorporated is relatively inexpensive to produce, is easy and quite intuitive to use, and does not interfere in any manner with the operation of the otherwise conventional control circuit 36.

Figure 4:
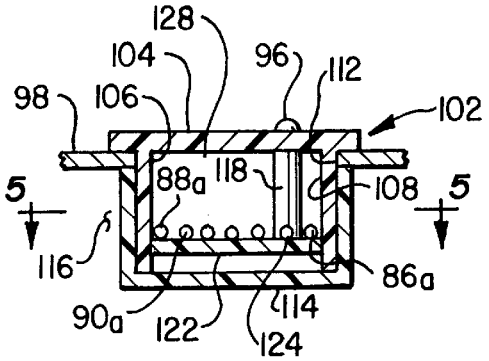
FIG. 4 is an enlarged scale simplified cross-sectional view through the LED indicating light panel taken along line 4—4 of FIG. 3.
Figure 5:
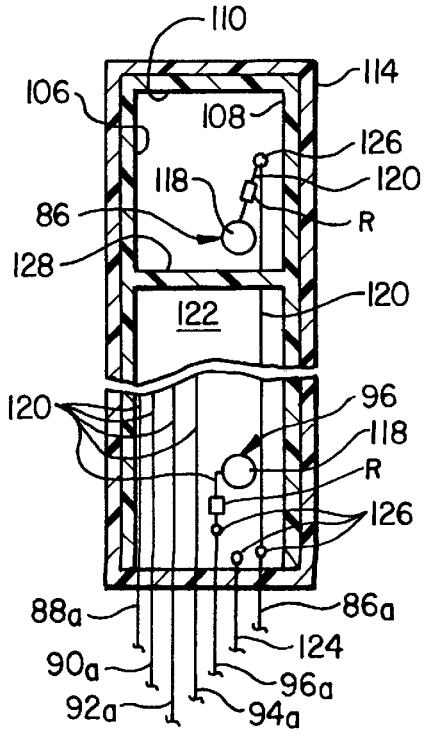
FIG. 5 is a simplified cross-sectional view through the LED indicating light panel taken along line 5—5 of FIG. 4.

Another aspect of the present invention is illustrated in simplified form in FIGS. 3–5. Specifically, the six LED indicating lights 86–96 are carried by an elongated rectangular light housing 102 having a front wall 104 from which an opposite pair of side walls 106,108 and an end wall 110 transversely project. As best illustrated in FIG. 4, the walls 106,108,110 extend inwardly through a rectangular opening 112 in the front wall 98 of the panel 100 and snap into an open sided rectangular cover structure 114 disposed within the interior 116 of the panel 100. The LED indicating lights 86–96 project outwardly through corresponding openings in the front light housing wall 104 and have body portions 118 disposed within the housing 102 and electrically coupled to electrical traces 120 formed on a circuit board 122 disposed within the housing 102.

The LED indicating light leads 86*a*–96*a*, and an associated ground wire 124, extend into the interior of the housing 102 and are operatively coupled to the electrical traces 120 at connection points 126 thereon. Each trace 120 has a resistor R interposed therein and mounted on the circuit board 122. The power indicating light 86 and its associated resistor R are physically isolated from the other lights 88–96 and their associated resistors R by an interior barrier wall portion 128 formed within the interior of the housing 102 and extending between the circuit board 122 and the front housing wall 104. The use of the barrier wall 128 prevents the power indicating light 86 and/or its associated resistor R from physically contacting any of the other indicating lights and their associated resistors should either or both of the indicating light 86 and its associated resistor R become dislodged from the circuit board 12.

The foregoing detailed description is to be clearly understood as being given by way of illustration and example only, the spirit and scope of the present invention being limited solely by the appended claims.

What is claimed is:

1. Liquid heating apparatus comprising:

a vessel for containing a liquid to be heated;

a heating system operative during a heating cycle to utilize electrical power and combustible fuel from sources thereof to maintain the liquid at a predetermined heated temperature by creating fuel combustion heat and transferring it to the liquid in response to the temperature of the liquid falling below said predetermined heated temperature, said heating system including a series of electrical components successively operative in a predetermined sequence during said heating cycle; and a diagnostic system operative to facilitate the identification of a malfunctioning one of said series of electrical components by creating a diagnostic signal indicative of the last component in said sequence to properly function during said heating cycle.

2. The liquid heating apparatus of claim 1 wherein said liquid heating apparatus is a fuel-fired water heater.

3. The liquid heating apparatus of claim 1 wherein said diagnostic signal is a visual signal.

4. The liquid heating apparatus of claim 1 wherein:

said diagnostic system includes a series of indicating lights each associated with one of said components, said series of indicating lights being supported in an ordered array corresponding in a predetermined manner to the sequence in which said series of components are electrically actuatable, and said diagnostic system is operative to successively illuminate each indicating light, in response to the presence of a predetermined voltage condition of its associated component, in a manner causing the last illuminated light to be indicative of the last component in said sequence thereof to have functioned properly.

5. The liquid heating apparatus of claim 4 further comprising descriptive indicia positioned adjacent each indicating light and identifying its associated component.

6. The liquid heating apparatus of claim 4 wherein said indicating lights are arranged in a single row.

7. The liquid heating apparatus of claim 6 wherein said indicating lights are LED lights.

8. The liquid heating apparatus of claim 1 wherein said components are electrically coupled to one another and include an electrical power switch, a thermostat, an ignition control, a fuel valve having pilot and main portions, and an energy cutoff switch.

9. The liquid heating apparatus of claim 5 wherein said descriptive indicia includes the terms "POWER", "THERMOSTAT", "IGNITION", "PILOT VALVE", "ECO" and "MAIN VALVE".

10. For use with liquid heating apparatus of the type having a vessel for containing a liquid to be heated, and a heating system operative to add heat to the liquid in a manner maintaining it at a predetermined heated temperature and including a series of electrically actuatable components each successively operative in a predetermined sequence to receive an electrical voltage from a preceding component and responsively cause the creation of an electrical actuation signal useable by a subsequent component in said sequence, a method of facilitating the identification of a malfunctioning one of said series of electrical components, said method comprising the steps of:

sensing the successive electrical actuation signals created by said components during operation of said heating system; and using the sensed electrical actuation signals to create a diagnostic signal indicative of the last component in said sequence to properly function.

11. The method of claim 10 wherein said step of creating a diagnostic signal is performed by creating a visual signal.

12. The method of claim 10 wherein said step of creating a diagnostic signal includes the steps of:

providing a series of indicating lights each associated with one of said components and supporting the indicating lights in an ordered array corresponding in a predetermined manner to the sequence in which said series of components are electrically actuated during operation of said heating system, and successively illuminating each indicating light, in response to a sensed presence of a predetermined electrical actuation condition of its associated component indicative of the proper operation of a preceding component, in a manner such that the last illuminated light is indicative of the last component in said sequence to have functioned properly.

13. The method of claim 12 wherein said illuminating step is performed in a manner continuously illuminating for a predetermined period each illuminated indicating light.

14. The method of claim 12 further comprising the step of placing descriptive indicia adjacent each indicating light to identify its associated component.

15. The method of claim 12 wherein said providing step includes the step of arranging said indicating lights in a single row.

16. The method of claim 15 wherein said providing step is performed using LED indicating lights.

17. The method of claim 14 wherein:

said electrical components are electrically coupled to one another and include an electrical power switch, a thermostat, an ignition control, a fuel valve having pilot and main portions, and an energy cutoff switch, and said step of placing descriptive indicia adjacent each indicating light is performed using indicia having the terms "POWER", "THERMOSTAT", "IGNITION", "PILOT VALVE", "ECO", and "MAIN VALVE".

18. A fuel-fired water heater comprising:

a vessel for containing water to be heated;

a heating system operative to utilize electrical power and combustible fuel from sources thereof to maintain the water at a predetermined heated temperature by creating fuel combustion heat and transferring it to the water in response to the water temperature falling below said predetermined heated temperature, said heating system including a series of electrical components connected in an electrical circuit, each component being successively operative in a predetermined sequence to receive electrical voltage and responsively cause the creation of an electrical actuation signal useable by a subsequent component in said sequence, said components including:

an electrical power switch, a thermostat coupled to said electrical power switch, an ignition control coupled to said thermostat, a fuel valve coupled to said ignition control, and an energy cutoff switch; and a diagnostic system operative to facilitate the identification of a malfunctioning one of said series of electrical components, said diagnostic system including a series of indicating lights each being associated with one of said components and being wired to said electrical circuit to sequentially illuminate the indicating lights, during operation of said heating system and in response to the presence of predetermined actuation signal conditions in their associated components, in a manner such that the last illuminated light in said series thereof provides a visual indication of the last component in said sequence that has functioned properly.

19. The fuel-fired water heater of claim 18 wherein said fuel-fired water heater is a gas-fired water heater.

20. The fuel-fired water heater of claim 18 further comprising a flue damper control interposed in said electrical circuit between said thermostat and said ignition control and operative, when energized by said thermostat, to transmit an electrical actuation signal to said ignition control.

21. The fuel-fired water heater of claim 18 wherein said indicating lights are LED lights, and said diagnostic system further includes:

a circuit board supporting said LED lights, one of said LED lights being a power indicating LED light, a series of electrical lead structures interconnected between said circuit board and said electrical circuit, each lead structure being associated with one of said components and operative to supply electrical power, via said circuit board, to the LED light associated with the component, each lead structure having a resistor connected therein and disposed on said circuit board, one of said lead structures being a power indicating lead structure operative to transmit electrical power to said power indicating LED light in response to electrical power being supplied from said source thereof to said series of components, and a barrier wall positioned adjacent said circuit board and serving to physically isolate said power indicating LED light and its associated resistor from the other LED lights and their associated resistors.

22. The fuel-fired water heater of claim 21 wherein:

said diagnostic system further includes an LED light housing structure in which said circuit board and said barrier wall are disposed, said LED light housing structure having an exterior wall with openings therein that receive said LED lights.

23. The fuel-fired water heater of claim 18 wherein said indicating lights are arranged in a single row.

24. The fuel-fired water heater of claim 23 wherein said indicating lights are LED lights.

25. The fuel-fired water heater of claim 18 further comprising descriptive indicia positioned adjacent each indicating light and identifying its associated component.

26. The fuel-fired water heater of claim 25 wherein said descriptive indicia includes the terms "POWER", "THERMOSTAT", "IGNITION", "PILOT VALVE", "ECO" and "MAIN VALVE".

* * * * *